US008103324B2

(12) United States Patent
Yang et al.

(10) Patent No.: US 8,103,324 B2
(45) Date of Patent: Jan. 24, 2012

(54) COVER MECHANISM AND ELECTRONIC DEVICE USING SAME

(75) Inventors: Mu-Wen Yang, Taipei Hsien (TW); Chih-Chiang Chang, Taipei Hsien (TW); Zheng Shi, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 502 days.

(21) Appl. No.: 12/339,241

(22) Filed: Dec. 19, 2008

(65) Prior Publication Data

US 2009/0296323 A1 Dec. 3, 2009

(30) Foreign Application Priority Data

May 30, 2008 (CN) ..... 2008 1 0301859

(51) Int. Cl.

| | |
|---|---|
| ***H04M 1/00*** | (2006.01) |
| ***H05K 5/00*** | (2006.01) |
| ***H05K 7/00*** | (2006.01) |
| ***A47B 81/00*** | (2006.01) |
| ***A47B 97/00*** | (2006.01) |

(52) U.S. Cl. ..... 455/575.8; 361/679.01; 312/223.2

(58) Field of Classification Search ..... 455/575.8; 361/679.1, 726, 727, 740, 747, 759, 801; 312/223.2; 174/66, 67; 49/463, 465; 220/780, 220/811; 16/261; 70/104, 129, 136

See application file for complete search history.

(56) References Cited

U.S. PATENT DOCUMENTS

| | | | | |
|---|---|---|---|---|
| 4,567,740 | A * | 2/1986 | Kelly | 70/55 |
| 5,793,619 | A * | 8/1998 | Deguchi | 361/814 |
| 2005/0049016 | A1 * | 3/2005 | Cho et al. | 455/575.1 |
| 2006/0148442 | A1 * | 7/2006 | Liu et al. | 455/347 |
| 2009/0290322 | A1 * | 11/2009 | Chang | 361/837 |

FOREIGN PATENT DOCUMENTS

| | | | |
|---|---|---|---|
| CN | 2610523 | Y | 4/2004 |
| EP | 668538 | A1 * | 8/1995 |

OTHER PUBLICATIONS

Review of Motorola Motorazr U9, Ivanov, Alexi, http://eng.mobiset.ru/articles/text/?id=40#1, Nov. 2007 (the full 150-page document is available on the internet, only selected pages are provided in this action to save resources).*

* cited by examiner

*Primary Examiner* — Dwayne Bost
*Assistant Examiner* — Larry Sternbane
(74) *Attorney, Agent, or Firm* — Altis Law Group, Inc.

(57) ABSTRACT

An electronic device using a cover mechanism to cover a hole is described. The cover mechanism includes a base member, a locking member, and a cover member. The cover member can be locked to the base member by locking of the cover member to the locking member when the cover member is in a locked position. The cover member can expose the hole and physically attach to the locking member when the cover member is in an opened position. The cover member can move relative to the locking member when the cover member is in a released position.

14 Claims, 5 Drawing Sheets

COVER MECHANISM AND ELECTRONIC DEVICE USING SAME

CROSS-REFERENCE TO RELATED APPLICATIONS

This application is related to co-pending U.S. patent application Ser. No. 12/339,245, entitled "COVER MECHANISM AND ELECTRONIC DEVICE USING SAME", by Mu-Wen Yang et al. Such applications have the same assignee as the present application and have been concurrently filed herewith. The above-identified applications are incorporated herein by reference.

BACKGROUND

1. Field of the Invention

The exemplary embodiment relates to cover mechanisms used in electronic devices.

2. Description of Related Art

Electronic devices usually have external interfaces (e.g., universal serial bus (USB)) for electrically connecting peripheral devices (e.g., printers), accessories (e.g., USB flash drives) or other electronic devices. Such external interfaces should be protected by cover mechanisms from e.g., dust or water, to maintain proper functioning.

The cover mechanisms usually include covers with locks. The covers are typically locked to the electronic devices by latches to cover the area through which the interfaces of electronic devices are exposed. However, the covers are often not permanently attached to the electronic device. Thus, the covers may easily be misplaced or lost when not locked to the electronic devices.

Therefore, there is room for improvement within the art.

BRIEF DESCRIPTION OF THE DRAWINGS

Many aspects of the exemplary cover mechanism and electronic device using the cover mechanism can be better understood with reference to the following drawings. These drawings are not necessarily drawn to scale, the emphasis instead being placed upon clearly illustrating the principles of the exemplary cover mechanism and the electronic device. Moreover, in the drawings like reference numerals designate corresponding parts throughout the several views. Wherever possible, the same reference numbers are used throughout the drawings to refer to the same or like elements of an embodiment.

DETAILED DESCRIPTION OF THE EMBODIMENTS

Figure 1:
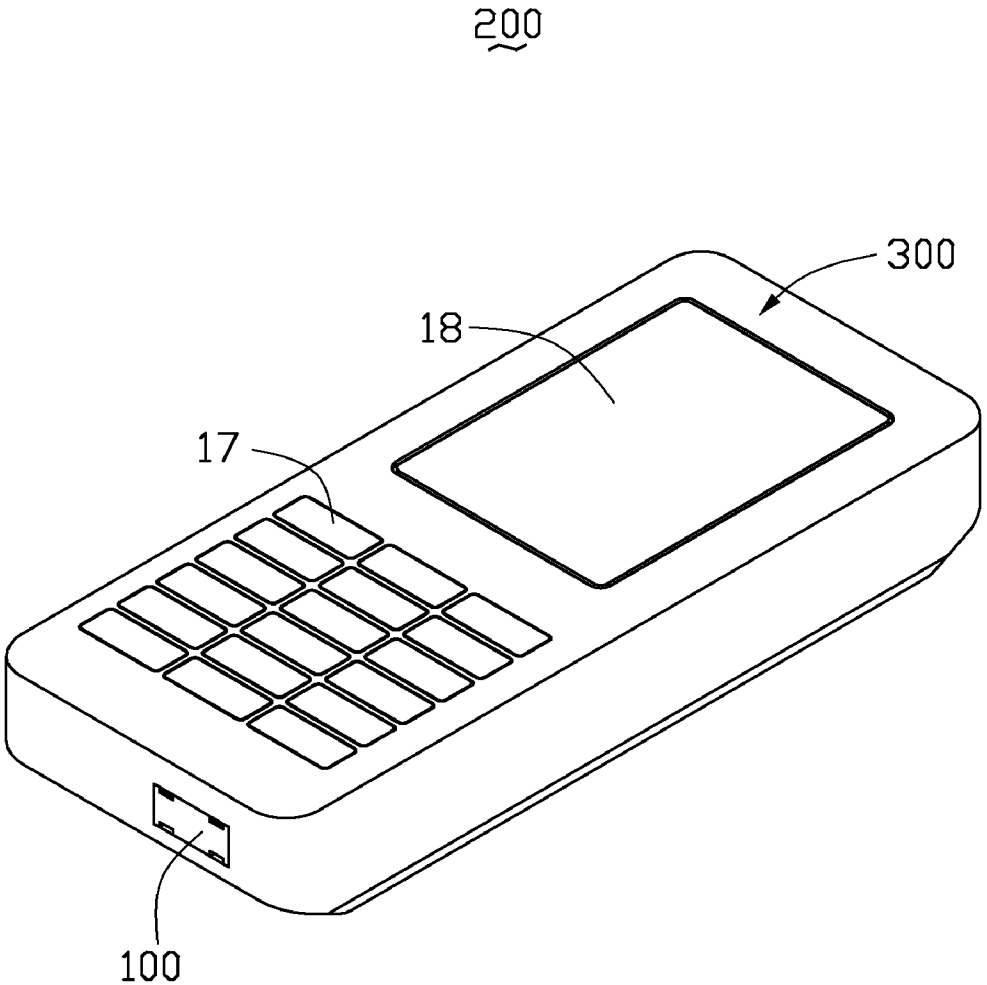
FIG. 1 is an isometric view of an electronic device including an exemplary cover mechanism.

FIG. 1 shows an exemplary electronic device in the form of a mobile phone 200 including an enclosed housing 300, a keypad 17, a display 18, and a cover mechanism 100.

Figure 2:
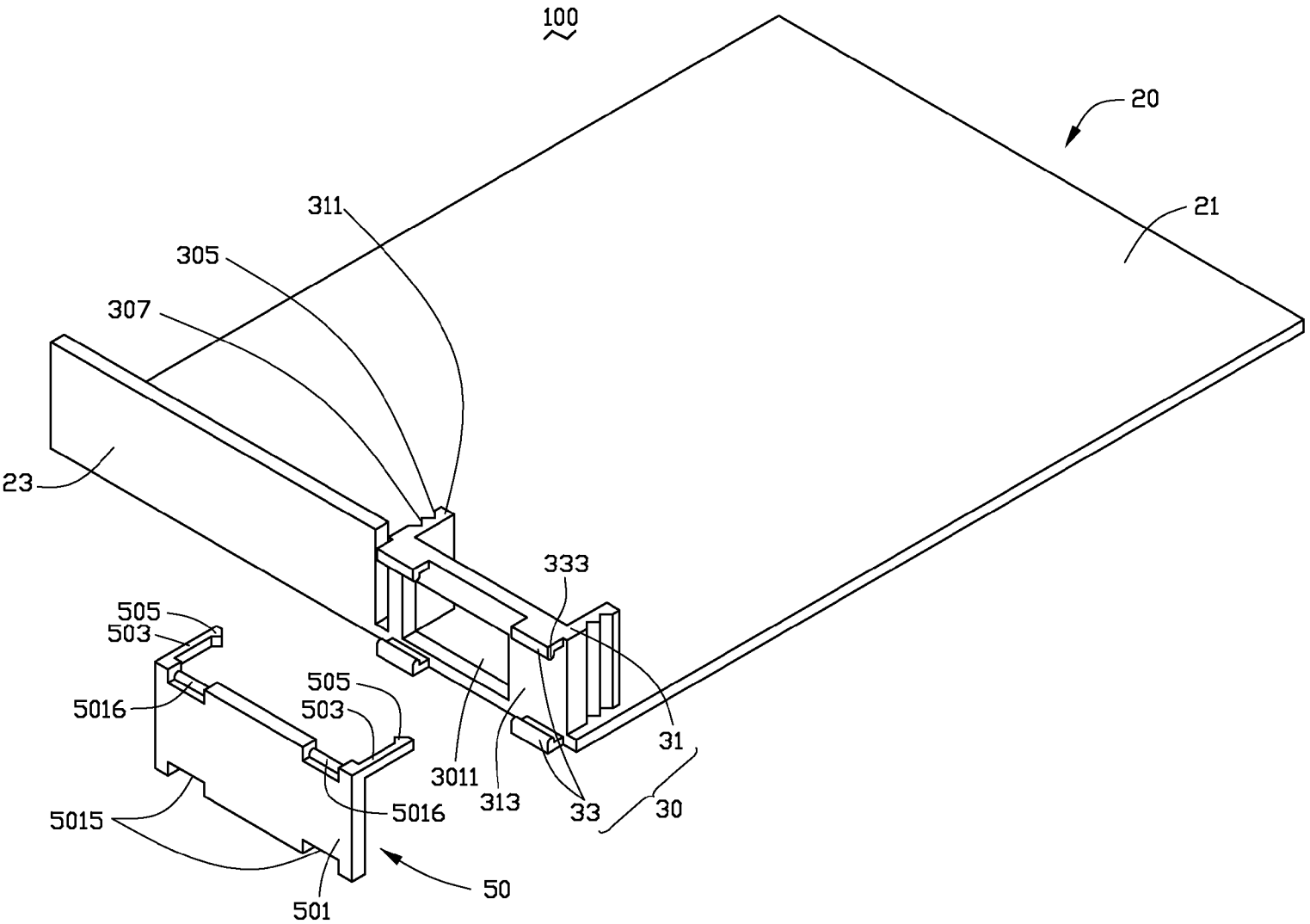
FIG. 2 is an exploded and isometric view of the cover mechanism shown in FIG. 1.

Referring to FIG. 2, the cover mechanism 100 includes a base member 20, a locking member 30, and a cover member 50. The base member 20 may be portions of the housing 300 and includes a bottom wall 21 and a sidewall 23 perpendicular to the bottom wall 21. The cover member 50 may be locked to the base member 20 by the locking member 30 to cover a hole 3011 (e.g., an interface hole) defined in the sidewall 23.

The locking member 30 is defined in the sidewall 23. The locking member 30 includes a positioning portion 31 and a plurality, e.g., four, L-shaped locking portions 33.

The positioning portion 31 includes two parallel side portions 311 and a top portion 313. Each side portion 311 defines a first positioning slot 305 and a second positioning slot 307 near the first positioning slot 305. The first positioning slot 305 and the second positioning slot 307 have substantially the same shapes (e.g., V shapes) and sizes. The longitudinal axes of the first positioning slot 305 and the second positioning slot 307 are substantially perpendicular to the bottom wall 21. The second positioning slot 307 is closer to the top portion 313 than the first positioning slot 305.

The locking portions 33, having similar structures, are arranged (e.g., co-molded) at corners of the side of the top portion 313 that is opposite to the side portions 311. Each locking portion 33 includes a wedge-shaped locking end 333 distal to the top portion 313. The locking ends 333 at an upper end of the top portion 313 are opposite to the other locking ends 333 at a lower end of the top portion 313. The hole 3011 is defined through the top portion 313 and surrounded by the locking portions 33.

The cover member 50 includes a rectangular cover portion 501 with two elastic positioning arms 503. The cover portion 501 is configured to cover the hole 3011 when the cover member 50 is locked to the base member 20. The cover portion 501 defines locking notches 5015 corresponding to the locking portions 33. The cover portion 501 further form locking protrusions 5016 inside the locking notches 5015 and corresponding to the locking ends 333.

Each of the positioning arms 503 is generally a rubbery rod extending from the cover portion 501 towards the locking portions 33. The positioning arms 503 can be made of rubber, soft plastic or other elastic materials. Each positioning arm 503 has a V-shaped positioning end 505 distal to the cover portion 501. The positioning end 505 is configured to be received and positioned within one of the first positioning slot 305 and the second positioning slot 307.

Figure 3:
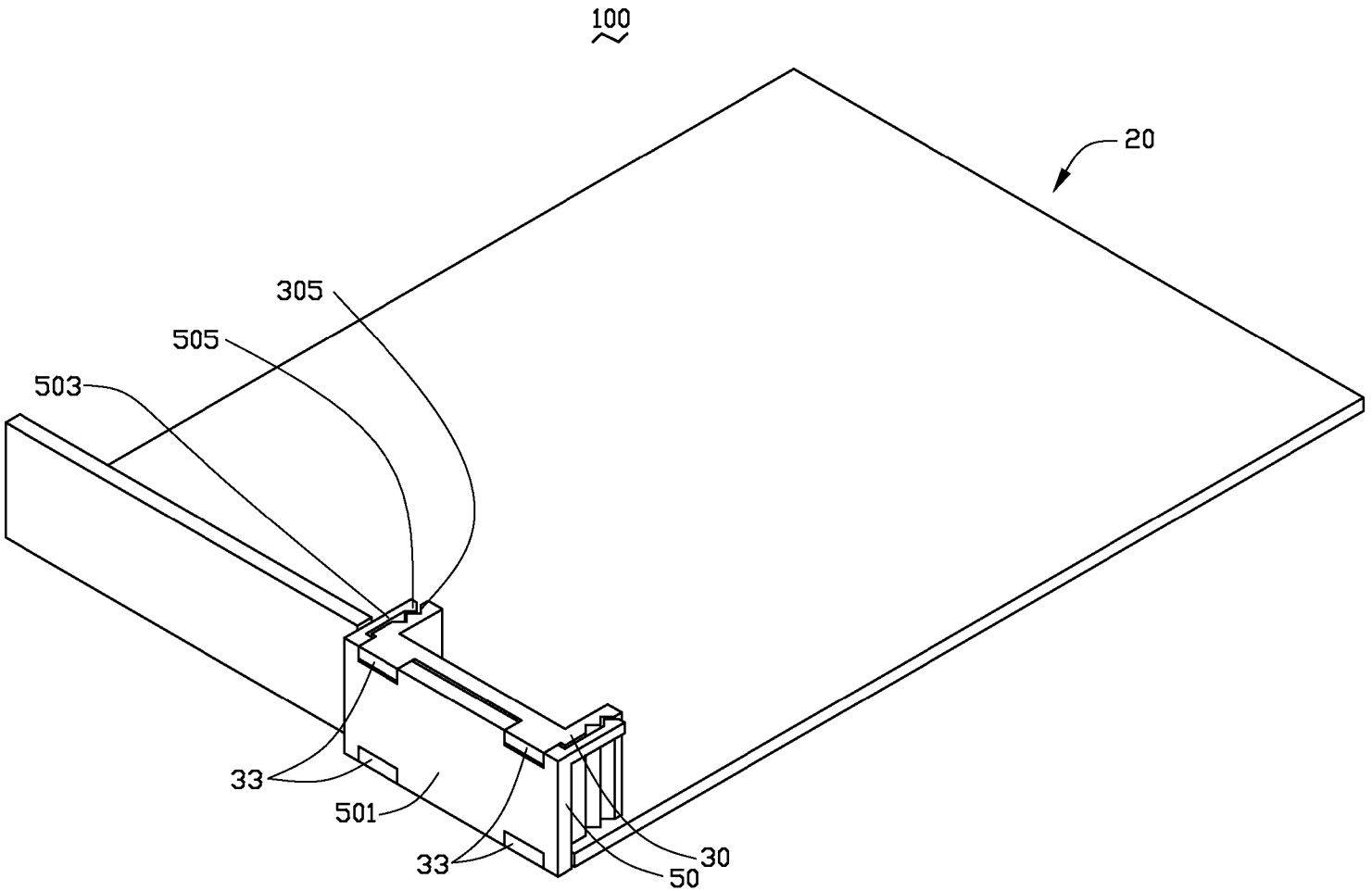
FIG. 3 is an isometric view of the cover mechanism shown in FIG. 1 in a locked position.

In FIG. 3, the cover mechanism 100 is in a locked position. In this position, the cover member 50 locks with the base member 20 by the locking member 30. The cover member 50 locks to the locking member 30 by engaging of the locking portions 33 into the locking notches 5015 to interlock the locking protrusions 5016 with the locking ends 33. In this state, the positioning arms 503 are positioned outside the positioning portions 31 and the positioning ends 505 are engaged within the first positioning slots 305. The cover portion 501 covers the hole 3011.

Figure 4:
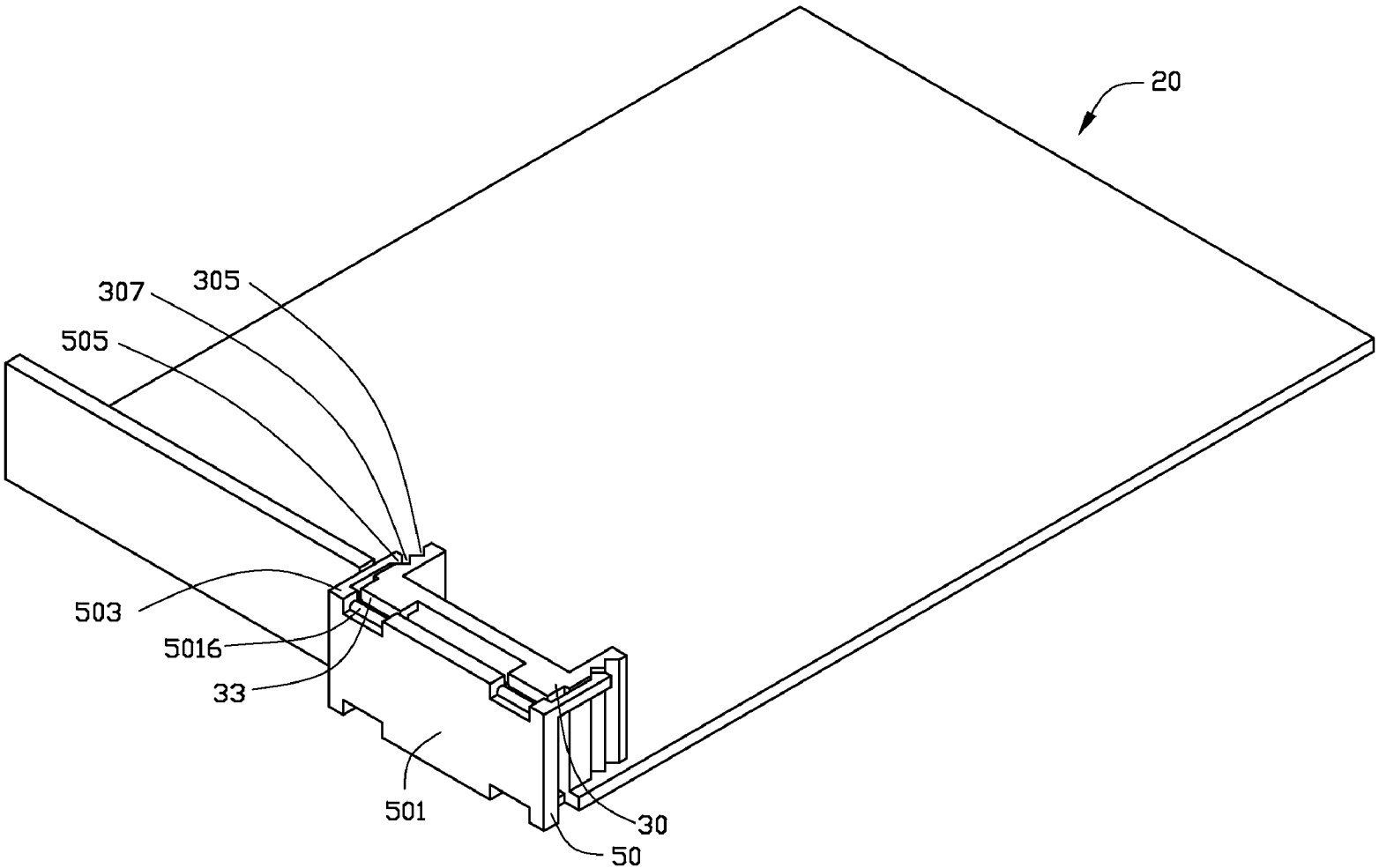
FIG. 4 is similar to FIG. 3, but in a released position.
Figure 5:
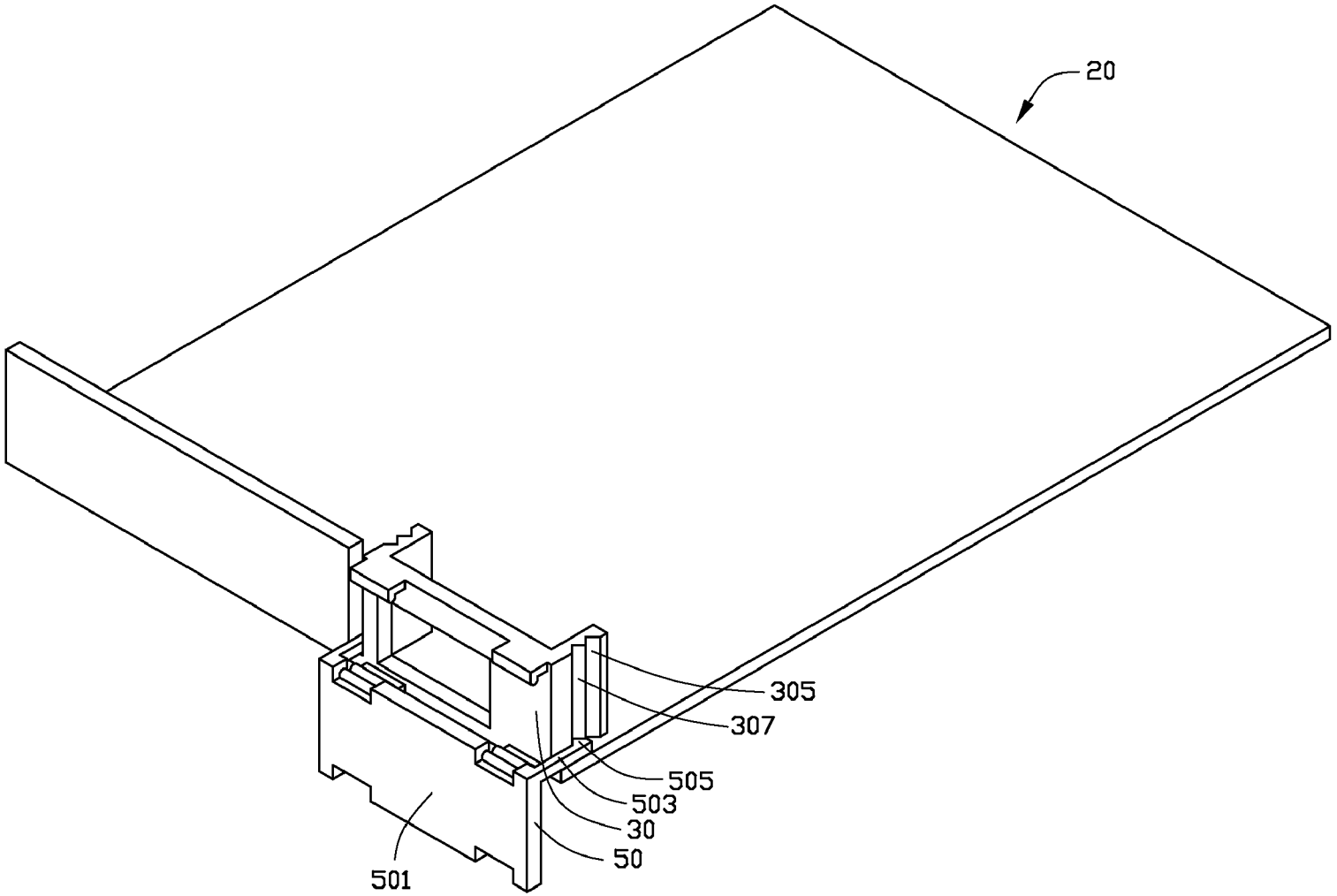
FIG. 5 is similar to FIG. 4, but in an opened position.

FIGS. 4 and 5 show a process of releasing the locking of the cover member 50 with the base member 20 from the locked position to a released position, and further to an opened position. In FIG. 4, the cover member 50 is pulled away from the locking member 30 to the released position in a first direction (e.g., a horizontal direction). During this stage, the positioning arms 503 deform and move backward, along with the positioning end 505 disengaging from the first positioning slot 305, and engaging into the second positioning slot 307. The cover portion 501 moves away from the locking member 30, and the interlocking of the locking protrusions 5016 with the locking ends 33 is released. At this time, the cover member 50 is released relative to the locking member 30 and the base member 20.

In FIG. 5, the cover member 50 is slid to the opened position. During this stage, by pressing the cover member 50 downwardly in a second direction substantially perpendicular to the first direction (e.g., a vertical direction), the positioning arms 503 move downwardly to the base member 20. The positioning ends 505 slide within the second positioning slots 307, and the positioning arms 503 move with respect to the positioning ends 505. As such, the hole 3011 is exposed and the cover portion 501 is moved below the hole 3011.

The positioning of the positioning ends 505 within the second positioning slots 307 prevents the cover member 50 from separating from the locking member 30 and the base member 20.

To close the cover mechanism 100, the above process is reversed and the cover member 50 is moved from the opened position to the released position, and further to the locked position).

It is to be understood, however, that even through numerous characteristics and advantages of the exemplary invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cover mechanism for covering a hole of an electronic device, the cover mechanism comprising:

a base member;

a locking member defined by the base member, the locking member defining a first positioning slot and a second positioning slot;

a cover member comprising an elastic positioning arm and configured for movement between:

a locked position, where the cover member is locked to the base member by locking of the cover member to the locking member, the positioning arm is positioned by the first positioning slot;

an opened position, where the cover member exposes the hole while being physically attached to the locking member; and a released position, where the cover member can move relative to the locking member and the positioning arm is positioned by the second positioning slot;

wherein, between the locked position and the released position, the positioning arm is deformable and movable; and between the released position and the opened position, the positioning arm is slidable along the second positioning slot; the cover member is further configured for moving relative to the locking member in a first linear direction between the releasing position and the locked position, and further in a second linear direction between the released position and the opened position, the second linear direction being substantially perpendicular to the first linear direction.

2. The cover mechanism as claimed in claim 1, wherein the cover member further comprises a cover portion configured to cover the hole, the positioning arm defining a positioning end distal to the cover portion, and the positioning end configured to be positioned within the first positioning slot or the second positioning slot depending upon whether the cover member is in the locked or released position, respectively.

3. The cover mechanism as claimed in claim 2, wherein the locking member comprises a positioning portion, the positioning portion comprises a side portion, the first positioning slot and the second positioning slot defined in the side portion.

4. The cover mechanism as claimed in claim 3, wherein the positioning portion further comprises a top portion, the hole is defined through the top portion, the first positioning slot is near the second positioning slot, and the second positioning slot is closer to the top portion than the first positioning slot.

5. The cover mechanism as claimed in claim 1, wherein:

the locking member comprises a plurality of locking portions;

the cover member defines a plurality of locking notches, each locking notch corresponding to one of the locking portions;

in the locked position, each locking portion locks into its corresponding locking notch; and in the released position and the opened position, the locking portions are released from their corresponding locking notches.

6. The cover mechanism as claimed in claim 5, wherein the locking portion comprises a locking end, the locking notch defines a locking protrusion therein, and the locking end is configured for interlocking with the locking protrusion when the cover member is in the locked position.

7. The cover mechanism as claimed in claim 6, wherein the cover member comprises a cover portion, and the locking portions are defined in opposite edges of the cover portion.

8. An electronic device, comprising:

a housing defining an hole;

a cover mechanism, comprising:

a base member being parts of the housing;

a locking member defined in the base member, the locking member defining a first positioning slot and a second positioning slot; and a cover member comprising an elastic positioning arm and configured for movement between:

a locked position, where the cover member is locked to the base member by locking of the cover member to the locking member, the positioning arm is positioned by the first positioning slot;

an opened position, where the cover member exposes the hole while being physically attached to the locking member; and a released position, where the cover member can move relative to the locking member and the positioning arm is positioned by the second positioning slot;

wherein, between the locked position and the released position, the positioning arm is deformable and movable; and between the released position and the opened position, the positioning arm is slidable along the second positioning slot; the cover member is further configured for moving relative to the locking member in a first linear direction between the releasing position and the locked position, and further in a second linear direction between the released position and the opened position, the second linear direction being substantially perpendicular to the first linear direction.

9. The electronic device as claimed in claim 8, wherein the cover member further comprises a cover portion configured to cover the hole, the positioning arm defining a positioning end distal to the cover portion, and the positioning end configured to be positioned within the first positioning slot or the second positioning slot depending upon whether the cover member is in the locked or released position, respectively.

10. The electronic device as claimed in claim 9, wherein the locking member comprises a positioning portion, the positioning portion comprises a side portion, the first positioning slot and the second positioning slot defined in the side portion.

11. The electronic device as claimed in claim 10, wherein the positioning portion further comprises a top portion, the hole is defined through the top portion, the first positioning slot is near the second positioning slot, and the second positioning slot is closer to the top portion than the first positioning slot.

12. The electronic device as claimed in claim 8, wherein:

the locking member comprises a plurality of locking portions;

the cover member defines a plurality of locking notches, each locking notch corresponding to one of the locking portions;

in the locked position, each locking portion locks into its corresponding locking notch; and in the released position and the opened position, the locking portions are released from their corresponding locking notches.

13. The electronic device as claimed in claim 12, wherein the locking portion comprises a locking end, the locking notch defines a locking protrusion therein, and the locking end is configured for interlocking with the locking protrusion when the cover member is in the locked position.

14. The electronic device as claimed in claim 13, wherein the cover member comprises a cover portion, and the locking portions are defined in opposite edges of the cover portion.

* * * * *